United States Patent [19]

Mitchell

[11] Patent Number: 4,619,443

[45] Date of Patent: Oct. 28, 1986

[54] GAS DISTRIBUTING TUNDISH BARRIER

[75] Inventor: George K. Mitchell, Randfontein, South Africa

[73] Assignee: Rand Steel Technology [Proprietary] Limited, Randfontein, South Africa

[21] Appl. No.: 657,061

[22] Filed: Oct. 2, 1984

[30] Foreign Application Priority Data

Oct. 6, 1983 [ZA] South Africa ..... 83/7463

[51] Int. Cl.[4] ..... C21C 5/48

[52] U.S. Cl. ..... 266/220; 266/229; 266/275

[58] Field of Search ..... 266/217, 220, 227, 228, 266/229, 265, 266, 274, 275; 75/59

[56] References Cited

U.S. PATENT DOCUMENTS

| | | | |
|---|---|---|---|
| 2,589,301 | 3/1952 | Smith | 266/220 |
| 3,053,525 | 9/1962 | Leroy et al. | 266/220 |
| 4,007,923 | 2/1977 | Chia | 266/227 |
| 4,165,235 | 8/1979 | Dantzig et al. | 266/227 |
| 4,277,281 | 7/1981 | Weber et al. | 266/227 |
| 4,468,012 | 8/1984 | Daussan et al. | 266/220 |

FOREIGN PATENT DOCUMENTS

| | | | |
|---|---|---|---|
| 927827 | 6/1963 | United Kingdom | 266/220 |

*Primary Examiner*—L. Dewayne Rutledge
*Assistant Examiner*—Robert L. McDowell
*Attorney, Agent, or Firm*—Bucknam and Archer

[57] ABSTRACT

A cast dam, for use in a tundish, is described. The dam is positioned between the tundish walls in the lower part and protrudes from the tundish floor. It has an L-shape. The dam has ducts connected to at least one pipe for conveying a supply of gas to the tundish. The ducts extend from the pipe to at least one dam surface which becomes exposed to molten metal during use of the tundish. A weir is also provided in the tundish.

6 Claims, 4 Drawing Figures

GAS DISTRIBUTING TUNDISH BARRIER

The invention provides a dam (6), for use in a tundish (5), having passages (10) formed therein which are adapted to discharge gas through the operatively upper surface of the dam (6).

Liquid metal which is cast using a tundish as an intermediate pouring vessel is not always afforded sufficient residence time to allow non-metallic inclusions to become separated from the metal, or to allow entrained gasses to escape.

The dam according to this invention is intended to improve the circulation of liquid metal being held in a tundish, so that the effective capacity of tundishes, in particular large tundishes, is fully utilized and "dead spaces" are substantially eliminated.

FIELD OF THE INVENTION

This invention relates to a barrier for use in a tundish, and more particularly to a barrier which is adapted to increase the residence time of liquid metal which is being held in a tundish for pouring into an ingot mould.

BACKGROUND OF THE INVENTION

Liquid metal which is cast using intermediate pouring vessels, herein referred to as tundishes, is not always afforded sufficient residence time to allow non-metallic inclusions to become separated from the metal, or to allow entrained gases to escape and thus to produce a cast metal of desired purity and soundness. Evidently, residence time can be increased by providing tundishes of large capacity. Nevertheless, even in tundishes of particularly large capacity, for example, twenty thousand kilograms, the problem of insufficient residence time may be encountered. This is a result of large volumes of liquid metal occupying "dead spaces" in the tundish wherein the metal does not circulate and which reduce the effective capacity of the tundish.

In order to improve the circulation of liquid metal into "dead spaces", and thereby increase the residence time of the liquid metal, tundishes have been developed in which the metal flow is diverted using barriers. These barriers are usually but not necessarily substantially rectangular in cross-section and extend between the tundish walls in a direction which is transverse to the prevailing flow of metal, between the metal entry and exit points. One type of barrier, which is commonly called a weir, is located at the upper part of the tundish walls and prevents liquid metal from flowing continuously across the surface of the metal bath while permitting the liquid metal to flow underneath the weir. Another type of barrier, which is commonly called a dam, is located between the tundish walls at the lower part thereof and protrudes from the tundish floor. The flow of liquid metal in a tundish which is equipped with a dam is directed to move over the surface of the dam. Conveniently, dams and weirs may be used together in order to produce a desired liquid metal flow pattern.

Other developements to improve liquid metal circulation include the incorporation of porous plugs in the tundish floor. In use, the plugs are adapted to encourage metal circulation by introducing a flow of inert gas into the molten metal bath. Problems associated with this method include the reliability of the plugs to retain the molten metal, and the effectiveness of the relatively small surface areas of the plugs.

Still further developments include the incorporation of a gas distribution apparatus into a weir which in use, distributes inert gas bubbles through the liquid metal from the undersurface of the weir. The gas bubbles are emitted under pressure and tend to rise in the immediate vicinity of the weir. Their distribution is thus very limited, and the circulation of liquid metal is confined to the areas adjacent to the weir's lateral surfaces. As a result, the main flow of metal entering the tundish sill bypasses large areas of the tundish, and in effect, remains characterized by a short residence time.

It is the object of this invention to improve the quality of liquid metal before casting, by increasing the removal of non-metallic inclusions, and entrained gases, at least to a small extent, and also by providing a pouring stream of relatively uniform temperature and composition through the promotion of metal circulation in tundishes used for holding liquid metal during casting.

SUMMARY OF THE INVENTION

In accordance with this invention, there is provided a dam, as herein defined, for use in a tundish and having means adapted to discharge gas through the surface thereof.

Further features of the invention provide for the means to include passages formed in the body of the dam; for the passages to be adapted to distribute gas through the operatively upper surface of the dam; for the passages to be uniformly distributed along the length of the dam; and for the dam to be composed of refractory material.

Still further features of the invention provide for at least one opening to be provided in the dam which is adapted to facilitate drainage of the tundish, and for piping, suitable for providing a flow of gas, to be associated with the dam.

Further, the invention additionally provides a tundish having at least one dam as described above; for each dam to be associated with each liquid metal exit point of a tundish; and for at least one dam to be associated with at least one weir which is located between an operative liquid metal entry point and the dam.

Another feature of the invention provides for the location and dimensions of the dam to be selected to maximize the circulation of liquid metal within the tundish.

BRIEF DESCRIPTION OF THE DRAWINGS

In order that the invention may be more fully understood, one embodiment of the invention will be described with reference to the accompanying diagrammatic sketches in which.

DETAILED DESCRIPTION WITH REFERENCE TO DRAWINGS

Figure 1:
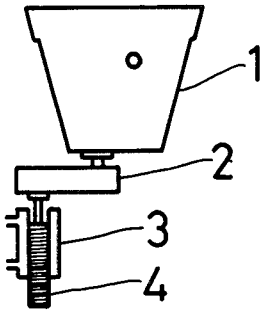
FIG. 1 illustrates a schematic view of a tundish in operative position.

Turning first to FIG. 1, there is illustrated a ladle 1 from which liquid metal is poured into a tundish 2 and poured further into water-cooled mould 3 to produce an ingot 4.

Figure 2:
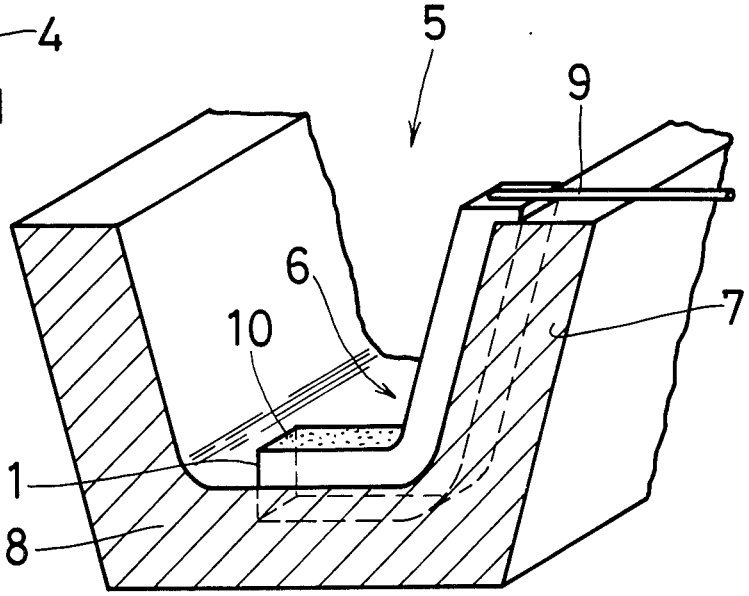
FIG. 2 illustrates a cross-sectional view of a tundish in a transverse plane which illustrates the manner in which a dam according to the invention may be associated with a tundish.

In FIG. 2, there is illustrated a tundish generally indicated by numeral 5, equipped with a dam generally indicated by numeral 6, which is shaped substantially like an "L", and which has been incorporated into a first wall 7, and the floor 8 of the tundish 5. The dam 6 is provided with a pipe 9, which, in use, is adapted to convey gas into the operatively upwardly extending leg of the dam 6 and into the operatively horizontal leg of the dam 6 which lies adjacent to the floor 8 of the tundish 5, for distribution into passages 10 provided in the operatively horizontal leg of the dam 6. The passages 10, which extend in an operatively vertical direction and terminate at the surface of the dam 6, are distributed throughout the length of the operatively horizontal leg of the dam 6. The dam 6 is preferably provided with an opening 11 at one end thereof to facilitate drainage of the tundish 5 but alternative openings may be provided through the dam 6 for this purpose.

In use, a gas, which is preferably an inert gas, for example argon gas, is fed under pressure via the pipe 9, and the passages 10 of the dam 6 to bubble through liquid metal contained in the tundish 5. The flow of inert gas bubbles is adapted through the location of the passages 10 to form a curtain which the liquid metal must traverse as it flows from entry to exit points. The liquid metal is thus agitated and this promotes its circulation, and ultimately increases its residence time, thereby increasing the opportunity for impurities to escape from the metal. The residence time of the liquid metal is further increased by the incorporation of the dam which in itself diverts the liquid metal flow in known manner.

The upwardly directed flow of inert gas moreover favours flotation of non-metallic inclusions to the metal surface where a slag may be formed, and additionally favours the degassing process by way of entrainment. The distribution of gas bubbles using a dam according to this invention provides for a substantial proportion of the metal flow to be intercepted by the gas bubble curtain, and moreover ensures that there is no proximate lateral surface which can act as a substrate for the attachment of bubbles and which can bias the direction of bubble flow.

Figure 3:
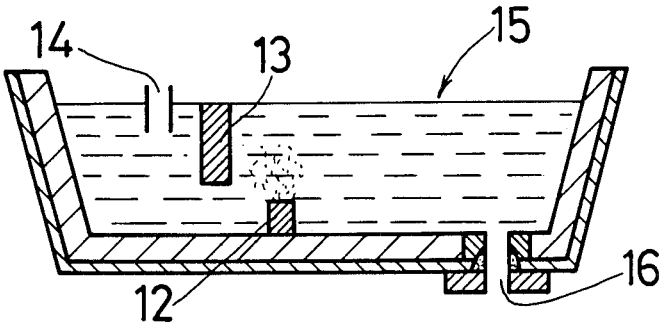
FIGS. 3 & 4 illustrate cross-sectional views of a tundish in a longitudinal plane which indicate various applications of the dam according to the invention.

A specific application of the dam according to the invention is illustrated in FIG. 3. Circulation of liquid metal, and retention of impurities which readily collect to the liquid metal surface are improved by using the dam 12 according to this invention in conjunction with a weir 13 located between the liquid metal entry point 14 and the dam 12. The liquid metal entry point 14 is at the extremity of the tundish 15 which is most remote from the liquid metal exit point 16.

Figure 4:
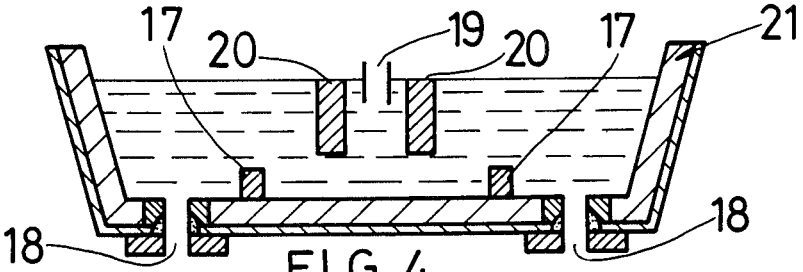

In a further application, illustrated in FIG. 4, dams 17 according to the invention are provided in a tundish generally indicated by numeral 21. Each dam 17 is associated with a liquid metal exit point 18. Once more, the liquid metal entry point 19 is situated remote from the liquid metal exit points 18, and is separated from the dams 17 by weirs 20.

The dam according to this invention is preferably made of vibratory cast refractory material. Conveniently, the passages may be formed by providing removable cores which are located in the mould during casting of the dam.

It is understood that the passages which are adapted to convey gas to intercept the flow of liquid metal in the tundish may be formed in a number of ways and that the invention is not limited to the embodiment described above.

The dam according to this invention is thus a useful addition to the standard tundish and, in use, is expected to facilitate the production of a high quality metal ingot substantially free from impurities.

What is claimed and desired to be secured by U.S. Letter Patent is:

1. A tundish having at least one cast dam, and located in use, between the tundish walls at the lower part thereof so that it protrudes from the tundish floor; the dam having gas distributing means operatively connected to at least one pipe for conveying a supply of gas to the tundish; the gas-distributing means including a plurality of ducts formed in the body of the dam during casting thereof, and extending from the pipe to at least one dam surface which becomes exposed to molten metal during use of the tundish, the dam having an opening for drainage.

2. The tundish according to claim 1 wherein said ducts are uniformly distributed along the length of the dam.

3. The tundish according to claim 1 wherein the dam is composed of refractory material.

4. A tundish according to claim 1 wherein at least one dam is associated with at least one weir which is located between an operative liquid metal entry point and the dam.

5. A tundish according to claim 1 wherein at least one dam is associated with each liquid metal exit point.

6. The tundish according to claim 1 wherein the dam is L-shaped and the long leg of the L is incorporated with one wall of the tundish and the short leg of the L is adjacent to the floor of the tundish.

* * * * *